US012140016B2

(12) United States Patent
Nielsen et al.

(10) Patent No.: US 12,140,016 B2
(45) Date of Patent: Nov. 12, 2024

(54) DOWNHOLE SENSOR PACKAGE

(71) Applicant: DataCan Services Corp., Red Deer (CA)

(72) Inventors: John Nielsen, Red Deer (CA); Lee Hayford, Calgary (CA); Michael Vlaicov, Springbrook (CA); Mark Hartwell, Houston, TX (US); Casey Bechdol, Belville, TX (US); Stephen Snelgrove, Red Deer County (CA)

(73) Assignee: DataCan Services Corp., Red Deer (CA)

( * ) Notice: Subject to any disclaimer, the term of this patent is extended or adjusted under 35 U.S.C. 154(b) by 0 days.

(21) Appl. No.: 18/363,899

(22) Filed: Aug. 2, 2023

(65) Prior Publication Data

US 2024/0102378 A1 Mar. 28, 2024

Related U.S. Application Data

(60) Provisional application No. 63/410,734, filed on Sep. 28, 2022.

(51) Int. Cl.
*E21B 47/017* (2012.01)

(52) U.S. Cl.
CPC ..... *E21B 47/017* (2020.05)

(58) Field of Classification Search
CPC ..... E21B 47/01; E21B 47/017; E21B 47/06; E21B 47/07
See application file for complete search history.

(56) References Cited

U.S. PATENT DOCUMENTS

2017/0350241 A1* 12/2017 Shi ..... E21B 21/08
2018/0177064 A1* 6/2018 van Pol ..... G01N 29/02
2019/0316459 A1* 10/2019 Chen ..... E21B 43/26

* cited by examiner

*Primary Examiner* — Kristyn A Hall
(74) *Attorney, Agent, or Firm* — Kyle R Satterthwaite; Ryan W Dupuis; Ade & Company Inc

(57) ABSTRACT

A downhole gauge for recording data during well treatment comprised of an outer housing having pressure ports, and a pressure-tight inner housing wherein a plurality of sensors, a power source, and a memory configured to store measured data are housed. The outer housing consists of a first section having external pressure ports with a spherical outer surface and a cylindrical inner surface with a hollow lattice structure within, and a second half having no ports with a spherical outer surface and a conical inner surface with an internal hollow lattice structure within. The inner housing consists of a cylindrical body comprised of one section having no ports, and a second section having one port wherein a plurality of sensors can be affixed. The inner housing sections are releasably coupled to form a pressure-tight seal. Further, the outer housing sections are releasably coupled and enclose the inner housing therein.

16 Claims, 4 Drawing Sheets

DOWNHOLE SENSOR PACKAGE

CROSS-REFERENCE TO RELATED APPLICATIONS

This application claims benefit under 35 U.S.C. 119(e) of U.S. Provisional Application No. 63/410,734, filed Sep. 28, 2022, the entirety of which is incorporated herein by reference.

FIELD OF THE INVENTION

The present invention relates to reusable, electronically instrumented downhole measurement and recording devices to be deployed during in-fracture treatments to wellbores for oil and/or gas operations, which are not currently possible due to the reliability of the previous packaging techniques.

BACKGROUND OF THE INVENTION

Hydraulic fracturing or "fracking" is the process of injecting high-pressure fluids down a well bore to create small fissures in the surrounding rock formations to release trapped hydrocarbon deposits and increase production. The fissures are held open by suspended solids in the fracking fluid known as proppants. In horizontal wells, fracking is often done in multiple stages, with each stage being isolated after treatment. Isolation is often achieved with the use of frac plugs set along the well casing at varying intervals. Frac plugs often incorporate a frac ball in a ball-on-seat seal, creating a check valve prohibiting fluids from travelling downhole past the plug but allowing well fluids to travel up to the surface. After treatment, the frac balls can be flowed back to surface with the resulting production flow of the well and are captured in specialized surface equipment.

Operators of these wellbores currently rely on surface data to estimate bottom hole conditions. Improved data might be achieved by relying on sensor measurements from the downhole region being treated.

SUMMARY OF THE INVENTION

According to a first aspect of the invention, there is provided a downhole gauge comprising:

a ball-shaped outer housing composed of first and second outer housing sections that are configured for coupled assembly with one another to form said ball-shaped outer housing, while delimiting a hollow interior space within the ball-shaped outer housing, each housing section comprising an outer surface of spherically contoured shape that forms a partial fraction of a substantially spherical exterior of said ball-shaped outer housing, when assembled;

a sensor received or receivable within said hollow interior space of the outer housing at a position fluidly communicable with a surrounding environment outside the outer housing via one or more ports in said exterior of said ball-shaped outer housing;

an inner housing composed of first and second inner housing sections that are sized and shaped for mated interface with one another and for housed receipt thereof in the hollow interior space of the ball-shaped outer housing, when assembled from said plurality of outer housing sections;

a sealing arrangement defined between said inner housing sections at the mated interface thereof;

internal components carried internally of the inner housing assembly, and electrically connected to the sensor to enabling taking of measurements therefrom;

wherein the outer housing sections and inner housing sections are cooperatively shaped and sized such that coupled assembly of the outer housing sections together around the inner housing components imparts a mated and sealed relationship of the inner housing sections with one another at said mated interface.

According to a second aspect of the invention, there is provided a downhole gauge comprising:

a ball-shaped outer housing having a hollow interior space and a substantially spherical exterior;

a sensor received or receivable within said hollow interior space of the outer housing at a position fluidly communicable with a surrounding environment outside the outer housing via one or more ports in said exterior of said ball-shaped outer housing;

an inner housing sized and shaped for housed receipt thereof in the hollow interior space of the ball-shaped outer housing;

internal components carried internally of the inner housing assembly, and electrically connected to the sensor to enable taking of measurements therefrom; and a sealing arrangement configured to provide a pressure-tight closure of the inner housing that protects the internal components housed therein;

wherein a portion of the inner housing is fluidly exposed to the surrounding environment at one or more areas of the inner housing at which exertion of external pressure from the surrounding environment is operable to further tighten said pressure-tight closure of the inner housing.

According to a third aspect of the invention, there is provided a downhole gauge comprising:

a ball-shaped outer housing having a hollow interior space and a substantially spherical exterior;

a sensor received or receivable within said hollow interior space of the outer housing at a position fluidly communicable with a surrounding environment outside the outer housing via one or more ports in said exterior of said ball-shaped outer housing;

an inner housing sized and shaped for housed receipt thereof in the hollow interior space of the ball-shaped outer housing;

internal components carried internally of the inner housing assembly, and electrically connected to the sensor to enable taking of measurements therefrom; and a sealing arrangement configured to provide a pressure-tight closure of the inner housing that protects the internal components housed therein;

wherein the outer housing is of lesser density than the inner housing.

According to a fourth aspect of the invention, there is provided a downhole gauge comprising:

a ball-shaped outer housing having a hollow interior space and a substantially spherical exterior;

a sensor received or receivable within said hollow interior space of the outer housing at a position fluidly communicable with a surrounding environment outside the outer housing via one or more ports in said exterior of said ball-shaped outer housing;

an inner housing sized and shaped for housed receipt thereof in the hollow interior space of the ball-shaped outer housing; and internal components carried internally of the inner housing assembly, and electrically connected or connectable to the sensor to enable taking of measurements therefrom;

wherein the sensor resides externally of the inner housing, and the internal componentry housed internally of the inner housing includes a circuit board mounted directly to the sensor via output pins thereof that lie perpendicularly of the circuit board.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
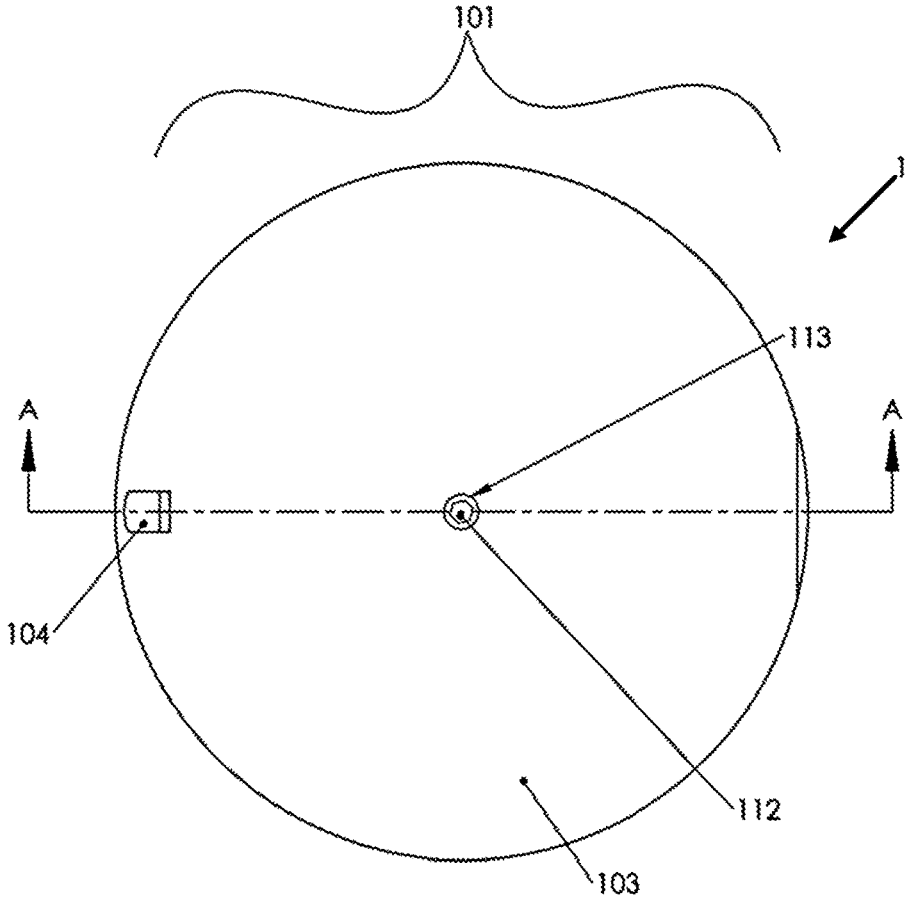
FIG. 1 is a side view of an embodiment of a downhole gauge in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to". Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

During a hydraulic fracing operation, a highly pressurized liquid, referred to as the "frac fluid," is pumped down the wellbore and is utilized to initiate and propagate cracks or fractures in the formation rock extending from perforations in the casing that lines the wellbore. Typically, fracking is performed at a plurality of spaced intervals along the wellbore, each interval defining a frac "stage." At each stage, the casing is perforated and then the portion of the formation extending from the perforations is fracked. Previously fracked stages are isolated from the particular stage being fraced. The cracks formed in the formation by fracking define flow paths through which hydrocarbons in the formation can flow, thereby enhancing fluid communication between the reservoir in the formation and the wellbore.

The pressure and temperature profiles in at the bottom hole during a perforation job provide insight into the effectiveness of the perforation. For example, the size of the pressure spike at the bottom hole assembly (BHA) during a perforation can provide insight into the size and/or geometry of the resulting perforations. As another example, an increase in the temperature of fluids surrounding the BHA shortly after a perforating the casing may indicate an influx of relatively hot formation fluids into the wellbore, which confirms fluid communication between the wellbore and the surrounding formation (i.e., that the perforations extend through the casing). The pressure profile of the frac fluid within a given stage being fracked (i.e., at the location where the cracks in that stage are initiated) influences the development and behavior of the cracks, and thus, provides insight into the fracking process and formation mechanical properties, which can be used to assess and/or tailor a variety of subsequent activities (e.g., subsequent fracking cycles). In addition, the pressure profile of the fracking fluid during a fracking operation can be used to identify stages that were insufficiently isolated during fracking, which may also influence subsequent operations. For example, if a particular stage was not sufficiently isolated during fracking, it can be fracked again to ensure sufficient initiation and propagation of cracks in the formation surrounding that stage.

When working with downhole pressure and temperature measurements, it is preferable to obtain measurements as close as possible to the perforations, where either fluids are injected during a fracturing stage, or where reservoir fluids (including hydrocarbons) enter the wellbore. Embodiments described herein offer the potential to measure temperatures and pressures proximal the perforations to enable a more clear and accurate understanding of the fluid distribution (injection and/or production), as measurements proximal the perforations will substantially reduce and/or eliminate any fluid friction that is often misunderstood and yields significant uncertainties.

The acquisition of downhole temperature and pressure measurements in accordance with embodiments described herein, in particular the downhole treating pressure during fracturing, which is usually an important input into fracturing simulators, offers the potential to enhance the ability of engineers to use the downhole treating pressure to more accurately estimate number of perforations clusters hydraulically connected to the fracture network, the total amount of additional pressure at the nearwellbore (commonly referred as "nearwellbore" pressure), the type of fracture network or geometry being generated, and optimize the fracturing job treatment by adjusting parameters such as injection rate, sand concentration, fluid viscosity, chemicals added, etc.

Figure 2:
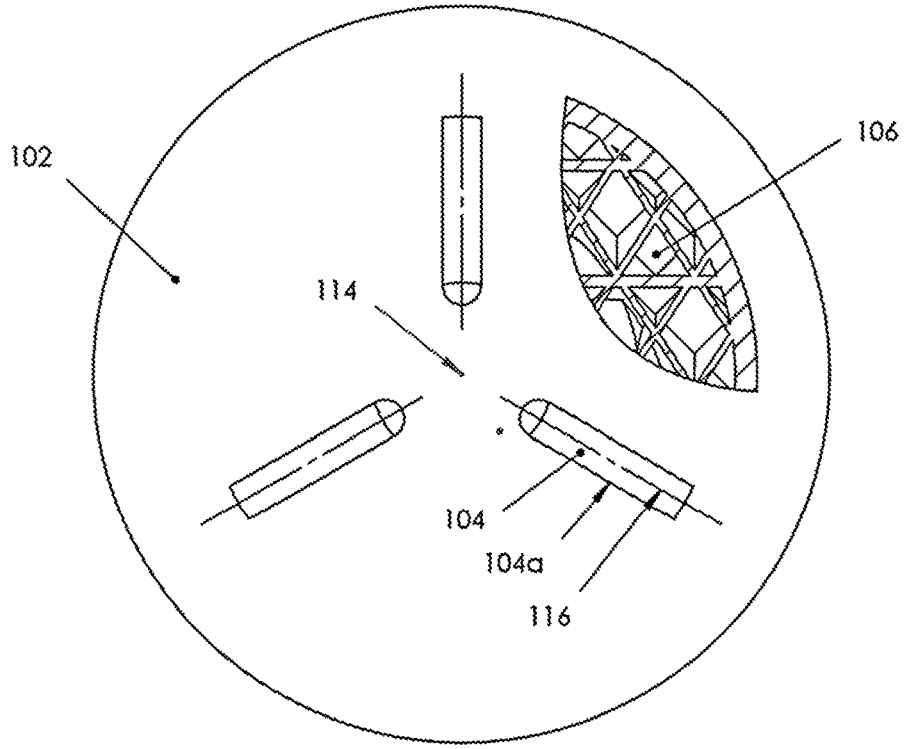
FIG. 2 is a front view of an embodiment of the downhole gauge with a partial cut out section showing an internal structure of an outer housing of the downhole gauge with the principles described herein.

The pressure and temperature profiles along a wellbore during production operations can assist with production profiling, as well as aid in the identification and location of loss circulation zones. For example, insight into the pressure and temperature within different stages of the wellbore over time can help the operator identify stages that are producing and stages that are not producing (or are insufficiently producing). In artificial lift production operations, comparison of the pressure profiles in the annulus (between a production string and the casing) and the inside of the production string can be used to determine the efficiency of the lift mechanism, and subsequently, optimize the lift mechanism employed. For at least the foregoing reasons, the pressure and temperature profiles of fluids in a wellbore during various downhole operations such as drilling, completion, and production operations can provide valuable insight. Embodiments of apparatus and methods described herein provide means for measuring downhole temperatures and pressures during a variety of downhole operations Referring to FIGS. 1, 2, and 3, an embodiment of a downhole gauge 100 for use in fracturing operations is shown. In this embodiment, the downhole gauge 100 is in the form of a spherical ball, and thus, may also be referred to as a "frac ball". In particular, the frac ball 100 includes an outer housing 101 comprised of a first outer housing section 102 (hereafter referred to as an outer body) and a second outer housing section 103 (hereafter referred to as an outer cap). The first section 102 has external pressure ports 104, a spherically contoured outer surface and a cylindrical inner surface 105, with an internal hollow lattice structure 106 interspersed between said outer and inner surfaces. The second section 103 has no ports, a spherically contoured outer surface and a conical inner surface 108, with an internal hollow lattice structure 106 interspersed between said outer and inner surfaces. In this embodiment, the respective internal hollow lattice structures 106 of the outer body 102 and the outer cap 107 are each a series of repeating planar surfaces spanning between the interior and exterior walls of the respective section 102, 103. The internal lattice structure 106 encloses a series of internal pockets that can be filled with air or other low-density materials of lesser density than the constituent material of which the outer body 102 and outer cap 103 are made, whereby this inclusion of a lower density filler, gaseous or otherwise, inside the lattice structure can be employed to adjust the overall density of the frac ball 100.

Figure 3A:
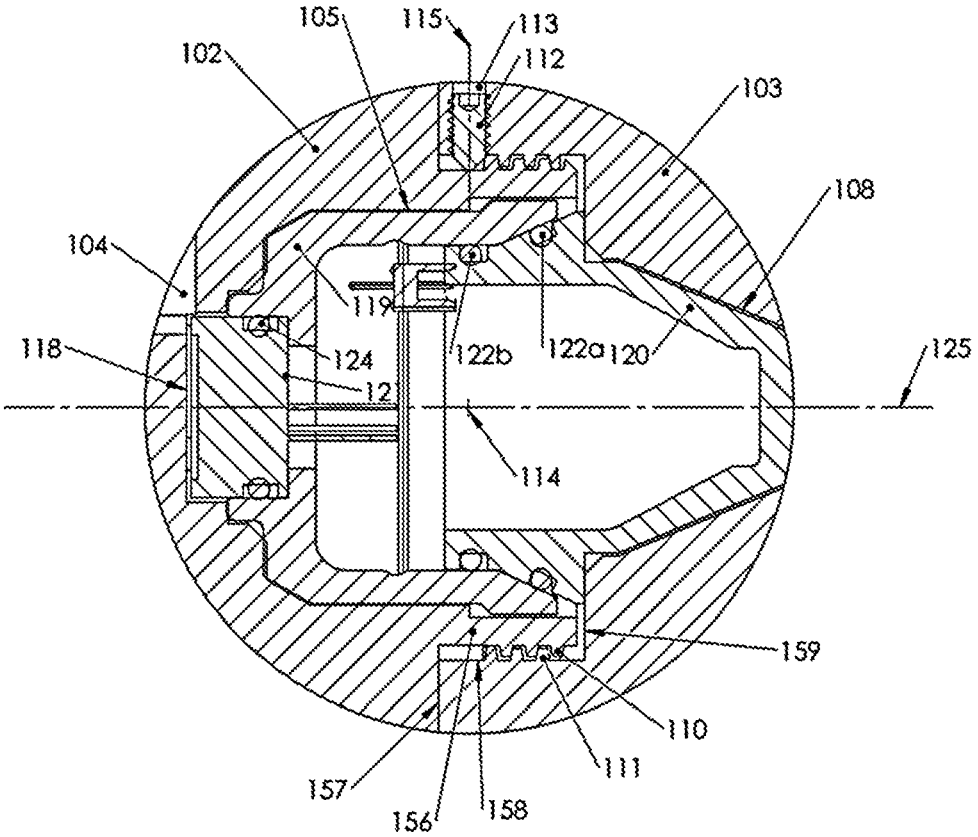
FIG. 3*a* is a cross-sectional view of the downhole gauge of FIG. 1 taken along section A-A of FIG. 1 showing an inner housing assembly of the downhole gauge seated in the outer housing thereof, with internal components of the inner housing assembly omitted for illustrative purpose.

The two outer housing sections are releasably coupled and contain the inner housing assembly 109. More specifically, in this embodiment, the outer housing sections are releasably coupled with male threads 110 on the outer body 102, and mating female threads 111 on the outer cap 103. The male threads 110 of the outer body 102 are provided on the outside of a cylindrical neck 156 of the outer body that projects axially from a truncation plane 157 of the outer body's externally spherical contour. The mating female threads 111 on the outer cap 103 are provided in a cylindrical counterbore 158 of the of the outer cap that is recessed thereinto from the truncation plane 157 of the outer cap's externally spherically contour. The conically tapered portion of the outer cap's hollow interior bound by conical surface 108 has a wide end that opens into the counterbore 158, but is of lesser diameter thereof, whereby the floor of the counterbore defines an annular shoulder 159 between the cylindrical counterbore 158 and the conical surface 108. Furthermore, in this embodiment the outer housing sections are additionally secured with the use of a set screw 112 disposed in a female threaded hole 113 in the outer cap 103. As shown in FIG. 3, the frac ball has a geometric center 114, and the set screw hole 113 has a longitudinal or central axis 115 that extends radially from the geometric center 114 to the to the outer surface of the frac ball 100. A central or longitudinal reference axis 125 passes diametrically through the geometric center 114, and the cylindrical inner surface 105 of the outer body 102 and the conical inner surface 108 of the outer cap 103 are centered on this reference axis 125.

In this embodiment, the outer body 102 includes three identical pressure ports 104 in the outer surface. Each pressure port 104 is a slot having a central slot axis 116, two parallel sides running in the slot's direction of elongation, and two ends of opposing relation to one another in said direction, of which the end nearest to the reference axis 125 is a radiused end. The bottom surfaces of the pressure ports 104 are coplanar with an endmost inner surface 118 of a hollow interior of the outer body 102, which is circumferentially bound by the aforementioned cylindrical inner surface 105. The endmost inner surface 118 of outer body's hollow interior lies distally opposite an open end of the outer body's externally threaded neck. The central slot axes 116 of the pressure ports 104 lie radially of the reference axis 125 and are angularly spaced therearound at equal intervals of 120°. The pressure ports 104 allow fluid communication between the inner housing assembly 109 and the surrounding environment. Naturally, the number, size or shape of the pressure ports 104 can be altered, for example a single, circular pressure port could be used in place of the radially arrayed pressure ports shown in the illustrated embodiment.

Figure 3B:
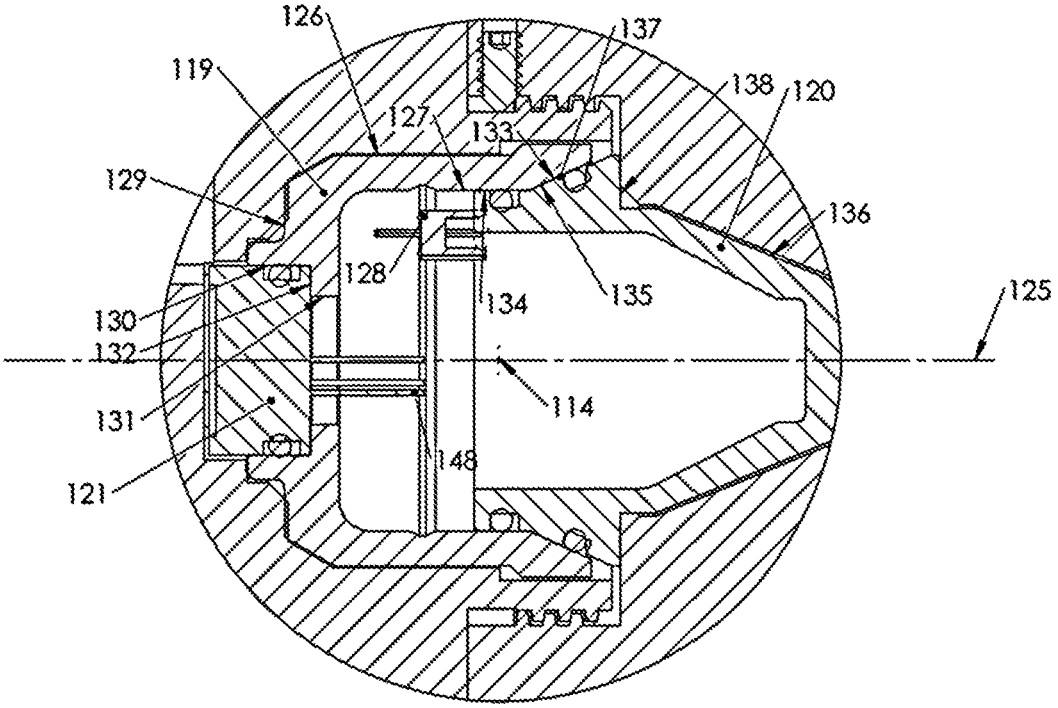
FIG. 3*b* is the same view as FIG. 3*a*, with different features labelled.
Figure 4:
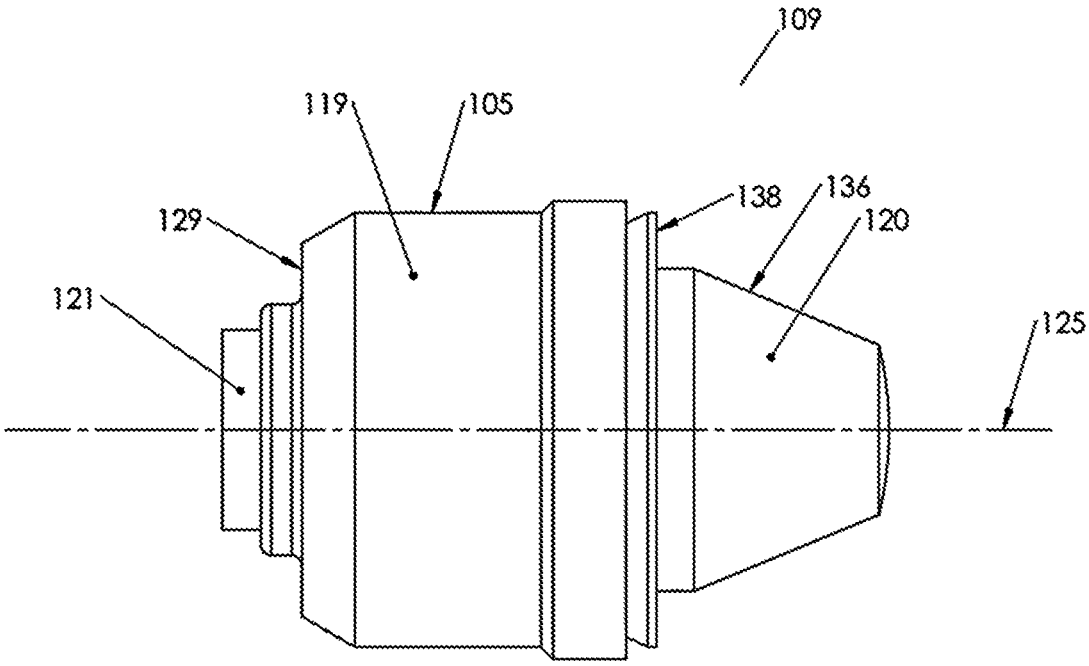
FIG. 4 is a side view of the inner housing assembly in accordance with the principles described herein.

Referring to FIGS. 3, 3*b*, and 4, the inner housing assembly 109 is comprised of a first inner housing section 119 (hereafter referred to as an inner body), a second inner housing section 120 (hereafter referred to as an inner cap), and a sensor 121, along with a first o-ring 122*a*, a second o-ring 122*b*, and a sensor o-ring with backup ring 124. In its assembled position inside the outer housing, the inner housing assembly 109 is likewise concentrically situated on the same reference axis 125 as the outer housing sections. The inner body 119 consists of a roughly cylindrical and internally hollow body with an open end that resides inside the externally threaded neck of the outer body 102, and an opposing partially closed end that resides further inside the outer body 102 nearer to the endmost surface 118 thereof. This roughly cylindrical body of the inner body 119 includes a cylindrical outer face 126, a cylindrical inner face 127 having a circumferential groove 128, and an external annular end face 129 that faces the plane of the outer body's endmost surface 118 and resides at the partially closed end of the inner body 119. This partially closed end of the inner body has a cylindrical through bore with a first section 130 that is nearer to the outer body's endmost surface 118 and has a larger diameter than a second cylindrical section 131 that penetrates the otherwise closed end of the inner body's generally cylindrical shape. This stepped diameter of the through bore defines an annular shoulder 132 between the differently dimensioned sections thereof, and this annular shoulder faces toward the plane of the endmost surface 118 of the outer body. In addition to the cylindrical inner face 127, the hollow interior of the inner body 119 is also bound by a conical face 133 flaring outwardly from cylindrical inner face 127 to the open end of the inner body 119.

The inner cap 120 consists of a roughly cylindrical body with an open end received in the hollow interior of the inner body 119 and a closed end residing outside the inner body 119 in distal relationship to the open end thereof at a location residing at or near the spherical exterior of the outer cap 103. The inner cap 120 has an exterior face that, moving from the open end of the inner cap 120 to the closed end thereof, includes a cylindrical section 134 having a gland designed to accept o-ring 122*b*, a first conical section 135 flaring outwardly from the cylindrical section 134 and having a gland designed to accept o-ring 122*a*, and a second conical section 136 tapering inwardly towards the closed end. Conical section 135 has a larger diameter than conical section 136, thus defining annular shoulder 138 therebetween that faces away from the inner body 119 and toward the closed end of the inner cap. The taper angle of conical section 136 on the inner cap 120 matches the taper angle of conical section 133 of inner body 119, whereby these conical sections define angled metal-to-metal sealing surfaces with an extrusion gap 137 therebetween. The taper angle of conical section 136 matches the taper angle of conical inner surface 108 of outer cap 103.

The outer body 102 and outer cap 103 are releasably coupled around the inner housing assembly 109such that the annular shoulder of the outer cap 103 makes abutting contact with the annular face 138 of the inner cap 120, and a similar and oppositely facing annular shoulder on the outer body 102, where the inner surface 105 thereof steps down in diameter toward the endmost surface 118, abuts against the annular face 129 of the inner body 119. All other surfaces of the inner housing assembly 109 do not contact any surfaces of the outer body 102 or the outer cap 103. Coupling the outer cap 103 to the outer body 102 around the inner housing assembly 109 forces the inner cap 120 into the inner housing, thus partially closing the extrusion gap 137. Applying external pressure to the frac ball 100 further forces the inner cap 120 into the inner body 119, thereby further closing the extrusion gap 137.

In the illustrated but non-limiting example shown in the drawings, the narrower end of the conically tapered inner cap 120 is directly exposed to the surrounding environment through an aperture in the outer cap 103, where the narrow end of the inner cap 120 is of convexly spherical contour so as to reside flush with the spherically contoured outer surface of the inner cap 120, whereby external pressure from the surrounding environment exerts an axial force on this narrow end of the inner cap, which tightens the mated fitting and sealed relationship between the inner housing sections where they conically interface with one another. This placement of the inner housing's narrow end at the exterior of the outer housing also minimizes the overall outer diameter of the ball relative to the size of the inner housing assembly. Even if this were not the case (for example in a larger diameter ball, where the narrow end of the inner cap is housed within the outer cap in non-exposed relation to the surrounding environment), the inner housing assembly would still be enveloped by pressurized fluid in a manner increasing the pressure tightness of the inner housing assembly, for example by admission of such pressurized fluid into the interior of the outer housing through the ports 104 therein, as well as through the mated threads of the outer housing sections. In other words, the outer housing is specifically not pressure tight, such that the external pressure can serve as a means to increase the pressure tightness of the inner housing assembly, and thereby better protect the internal components housed therein.

Figure 5:
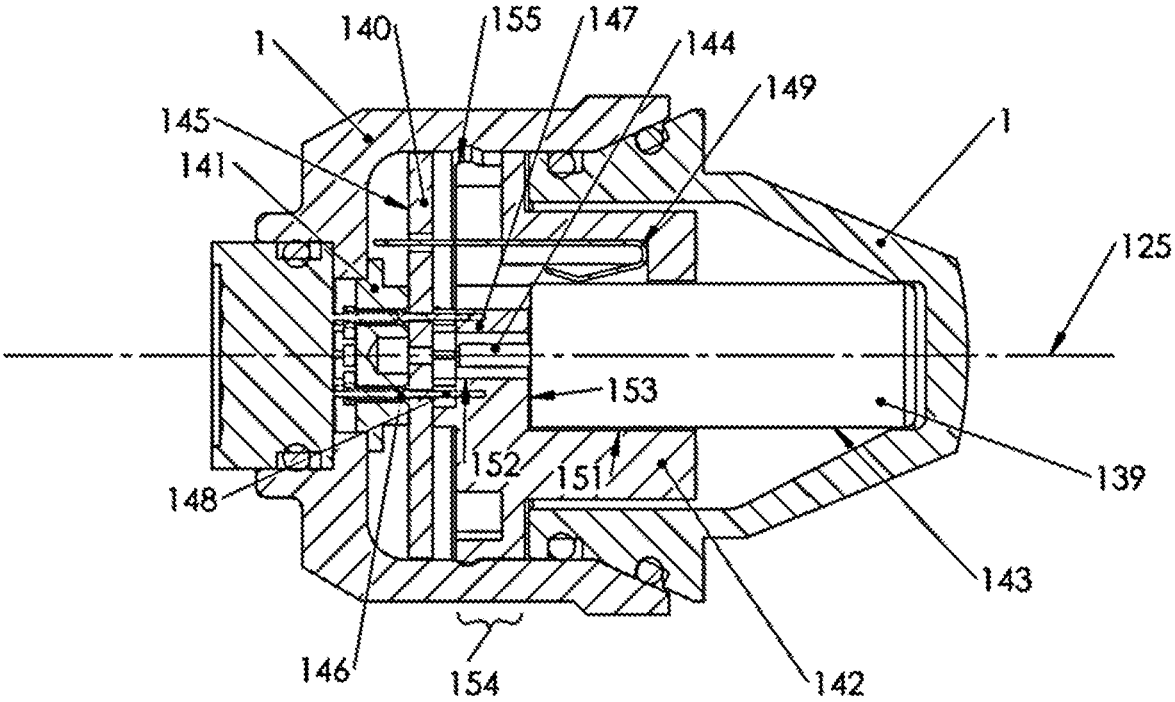
FIG. 5 is a cross-sectional view of the inner housing assembly of FIG. 4 taken along section line C-C of FIG. 4 showing the internal components of the inner housing that were omitted in FIGS. 3*a* and 3*b;*

Referring now to FIG. 5, the inner housing assembly 109 contains a power source 139 and a circuit card assembly (CCA) 140 electrically coupled together with the sensor 121. A CCA spacer 141 and a scaffold 142 hold the preceding parts in place inside the inner housing assembly 109. In this embodiment the power source is a lithium-ion battery constructed with a metal grounding case 143 surrounding the cell, and a glass feed thru isolating the protruding positive terminal 144 on one end. The CCA 140 consists of a printed circuit board (PCB) 145 having components electrically coupled to a first side that faces the partially closed end of the inner body 119, having additional components electrically coupled to an opposing second side that faces the open end of the inner body 119, and having a diameter equal to the cylindrical inner face 127 of the inner body 119. The CCA 140 includes a plurality of small friction contact sockets 146 on the first side at locations that align with output pins 148 of the sensor 121 and extend perpendicularly from the surface of the PCB 145. On the second side, the CCA 140 includes a single large friction contact socket 147 aligned in the center of the PCB disk 145 and extending perpendicularly from the surface of the PCB 147 and a spring terminal 149 also extending perpendicularly from the PCB 145. Additionally, with reference to FIG. 6, the CCA 140 includes a male pin connector 150 used for external communication, and a microprocessor (FIG. 7) which, in this embodiment is configured to measure and record a plurality of pressures and temperatures and store them in a memory (e.g. non-volatile memory).

Scaffold 142 is generally cylindrical in shape with one side truncated and includes a central cylindrical bore 151 penetrating a first end thereof that faces the closed end of the inner cap, and a concentric through bore 152 that penetrates an opposing second end of the scaffold and is smaller in diameter, thus defining an annular shoulder therebetween 153 that faces the closed end of the inner cap. Furthermore, the scaffold 142 includes a cylindrical flexible section 154 around the outer perimeter, having a triangular catch protrusion at the end 155 with an outer diameter larger than that of the inner cylindrical face 127 of the inner body 119. The scaffold also includes cutouts to provide clearance for various electrical components (not shown) on the CCA 140.

The sensor 121 is installed in the larger diameter section 130 of the cylindrical through-bore in the inner body 119 and abuts against annular face 132 with the output pins 148 extending inwardly through the smaller diameter section 131 of the through-bore. CCA spacer 141 includes a plurality of through-holes that are aligned with the small friction contact sockets 146 on the CCA 140 and is installed around the small friction contact sockets 146. The CCA 140 is releasably coupled to the sensor 121 by aligning and inserting the sensor output pins 148 in the small friction contact sockets 146 with the CCA spacer 141 disposed there between. The CCA 140 is affixed in a position of perpendicular and concentric relation to the reference axis 125. The scaffold 142 is inserted into the interior of the inner body behind the CCA 140, in an orientation aligning the through bore 152 with the large friction contact socket 147, and forcing the cylindrical flexible section 154 to initially yield radially inward before resiliently popping back outwardly to its default diameter to lock the catch protrusion into the circumferential groove 128, thus fixing the CCA 140 in place. The battery 139 is then installed in the scaffold's central bore 151, simultaneously having the metal grounding case 143 contact the spring terminal 149 and the positive terminal 144 insert into the large friction contact socket 147, thus powering the electronic assembly. The battery 139 seats against the scaffold's annular shoulder 153. The inner cap 120, along with o-rings 122*a* and 122*b*, encloses the inner housing assembly, forming a pressure tight seal in addition to fixing the battery 139 in place.

In this embodiment, the sensor 121 is a pressure and/or temperature sensor that measures the pressure and/or temperature within the envelope of the outer housing 101. Since the interior of the outer housing 101 is in direct fluid communication with the environment immediately outside the frac ball 100 via ports 104, the pressures and/or temperatures measured and recorded by the sensor 121 are indicative (i.e., the same or substantially the same) of the pressures and/or temperatures immediately outside the frac ball 100 adjacent the ports 104. The sensor 121 converts the measured pressure and/or temperature to an electrical signal that is communicated to the microprocessor, which records and stores the measured pressure and/or temperature in the memory. The battery 139 provides power to the electrical components within the frac ball 100 such that the frac ball 100 can function autonomously during deployment.

Figure 6:
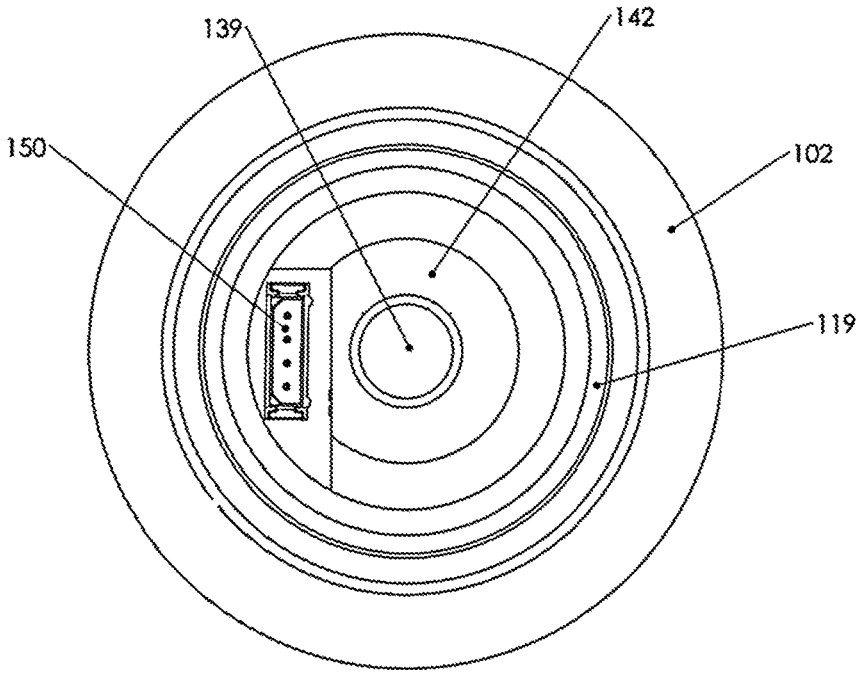
FIG. 6 is an end view of the inner housing assembly of FIG. 4 with the inner cap removed, showing the internal components of the inner housing.
Figure 7:
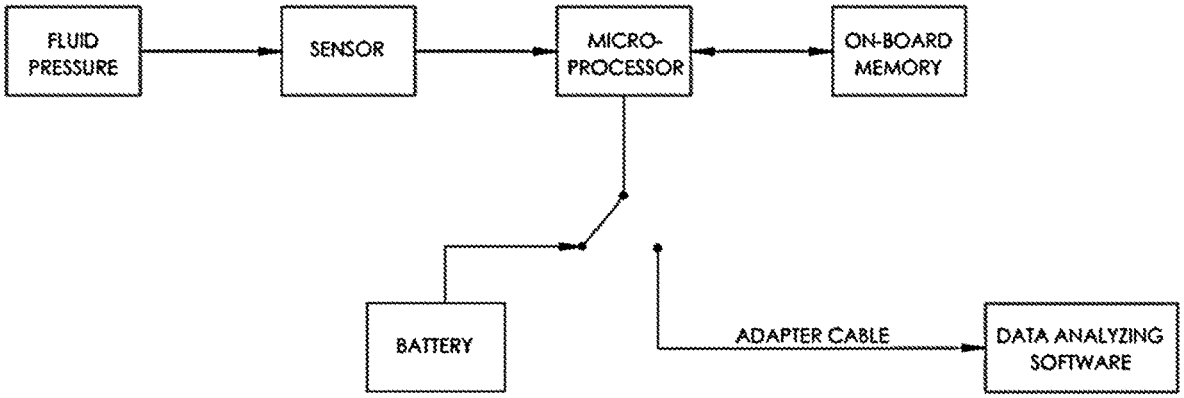
FIG. 7 is a schematic block diagram of electronic components of the downhole gauge.

In this embodiment, the pressure and/or temperature data recorded in the memory of the frac ball 100 is downloaded to an external device and analyzed at the surface after the frac ball 100 is retrieved to the surface. As best seen in FIG. 6, removing the outer cap 103 and the inner cap 120 provides access to the inner body 119 and male pin connector 150 therein, from which the stored memory can be downloaded through the use of an adapter cable.

For use in relatively harsh downhole conditions, the outer housing 101, inner housing 109, and sensor 121 are preferably designed to allow the CCA 140 and battery 139 to function at pressures of at least 15,000 psi and temperatures of at least 150° C. In this embodiment, the outer housing is a spherical ball. Although frac ball 100 can have any suitable outer diameter depending on the particular downhole application, in embodiments described herein, the frac ball 100 has an outer diameter preferably greater than or equal to 2" (50.8 mm). In one embodiment, the outer diameter of the frac ball 100 is 2.125" (54.0 mm). For use in the harsh downhole environment, outer housing 101 and inner housing 109 must be made of rigid, durable materials. In one embodiment, outer housing 101 is made of a carbon-fiber reinforced polyether ether ketone (PEEK), and inner housing 109 is made of a lightweight, chemical resistant alloy, for example titanium G5.

In general, the microprocessor can be configured to measure, record, and store measurement data including: pressures and/or temperatures, vibration, inclination, acceleration, flow, resistivity, and density, continuously or at any suitable frequency.

In embodiments described herein, the microprocessor preferably measures, records, and stores (hereafter referred to as "samples") measurement data at least once every 5 minutes, and more preferably at least once every 1 second. However, it should be appreciated that the frequency at which the microprocessor samples pressure and/or temperature data is variable and programmable, and thus, is not limited to the preferred ranges described above.

Without being limited by this or any particular theory, the greater the frequency at which pressure and/or temperature measurements are made and recorded, the greater the energy (battery) and memory requirements. Additionally, the microprocessor can be configured to employ a "pressure trigger" by which the microprocessor samples pressure and/or temperature at a slower rate (e.g. once per 5-10 minutes) pending a predetermined threshold pressure or temperature is reached, after which the microprocessor samples at a higher rate as disclosed above. This can decrease energy and memory requirements of the frac ball 100, allowing for higher sampling rates during well treatment.

Frac ball 100 can be used during completion operations to measure and record downhole pressures and/or temperatures during such operations, and then retrieved to the surface for subsequent analysis of the measured and recorded downhole pressures and/or temperatures.

What is claimed is:

1. A downhole gauge comprising:

a ball-shaped outer housing composed of first and second outer housing sections that are configured for coupled assembly with one another to form said ball-shaped outer housing, while delimiting a hollow interior space within the ball-shaped outer housing, each housing section comprising an outer surface of spherically contoured shape that forms a partial fraction of a substantially spherical exterior of said ball-shaped outer housing, when assembled;

a sensor received or receivable within said hollow interior space of the outer housing at a position fluidly communicable with a surrounding environment outside the outer housing via one or more ports in said exterior of said ball-shaped outer housing;

an inner housing composed of first and second inner housing sections that are sized and shaped for mated interface with one another and for housed receipt thereof in the hollow interior space of the ball-shaped outer housing, when assembled from said plurality of outer housing sections;

a sealing arrangement defined between said inner housing sections at the mated interface thereof;

internal components carried internally of the inner housing assembly, and electrically connected to the sensor to enabling taking of measurements therefrom;

wherein the outer housing sections and inner housing sections are cooperatively shaped and sized such that coupled assembly of the outer housing sections together around the inner housing components imparts a mated and sealed relationship of the inner housing sections with one another at said mated interface, and the sealing arrangement at the mated interface of the inner housing sections comprises an angled metal-to-metal seal accompanied by an elastomeric seal whose sealing effectiveness decreases with reduction of an extrusion gap of said metal-to-metal seal.

2. The downhole gauge of claim 1 wherein the outer housing is of lesser density than the inner housing.

3. The downhole gauge of claim 1 wherein a constituent material of the outer housing is of lesser material density than a constituent material of the inner housing.

4. The downhole gauge claim 1 wherein a plurality of internal pockets are delimited within the outer housing at locations outside the hollow interior space thereof in which the inner housing is received.

5. The downhole gauge of claim 4 wherein the outer housing is composed of a constituent material, and said internal hollow pockets contain a different material of lesser density than said constituent material.

6. The downhole gauge of claim 5 wherein said internal pockets are delimited by internal lattice structures contained within and embodied by said outer housing sections.

7. The downhole gauge of claim 1 wherein the sensor resides externally of the inner housing, and the internal componentry housed internally of the inner housing includes a circuit board mounted directly to the sensor via output pins thereof that lie perpendicularly of the circuit board.

8. The downhole gauge of claim 1 wherein the internal componentry housed internally of the inner housing includes a circuit board to which the sensor is operably connected, and a battery coupled directly to the circuit board.

9. The downhole gauge of claim 8 wherein the sensor and the battery are coupled to opposing sides of said circuit board.

10. The downhole gauge of claim 1 wherein a portion of the inner housing is fluidly exposed to the surrounding environment at one or more areas of the inner housing at which exertion of external pressure from the surrounding environment is operable to further tighten the mated and sealed relationship of the inner housing sections and thereby increase a pressure tightness of the inner housing, and exertion of said external pressure decreases the extrusion gap and improves a sealing action of said elastomeric seal.

11. The downhole gauge of claim 1 wherein the outer housing sections are configured for threaded coupling to one another.

12. The downhole gauge of claim 11 wherein the spherically contoured shape of the outer surface of each outer housing section terminates at a respective truncation plane, one of the outer housing sections has an externally threaded neck protruding from the respective truncation plane, and the other of the outer housing sections has an internally threaded bore in which the externally threaded neck is threadable to couple the outer housing sections together.

13. The downhole gauge of claim 1 further comprising a set screw operably engageable with the outer housing sections to impart a resistive hold against a potential decoupling thereof.

14. A downhole gauge comprising:

a ball-shaped outer housing having a hollow interior space and a substantially spherical exterior;

a sensor received or receivable within said hollow interior space of the outer housing at a position fluidly communicable with a surrounding environment outside the outer housing via one or more ports in said exterior of said ball-shaped outer housing;

an inner housing sized and shaped for housed receipt thereof in the hollow interior space of the ball-shaped outer housing; and internal components carried internally of the inner housing assembly, and electrically connected or connectable to the sensor to enable taking of measurements therefrom;

wherein the sensor resides externally of the inner housing, and the internal componentry housed internally of the inner housing includes a circuit board mounted directly to the sensor via output pins thereof that lie perpendicularly of the circuit board.

15. The downhole gauge of claim 14 wherein the internal componentry housed internally of the inner housing comprises a battery coupled directly to the circuit board at a side thereof of opposing relationship to the sensor.

16. The downhole gauge of claim 15 wherein the battery is coupled directly to the circuit board by connection pins of perpendicular relation thereto.

* * * * *